US006662810B2

(12) United States Patent
Gueret

(10) Patent No.: US 6,662,810 B2
(45) Date of Patent: Dec. 16, 2003

(54) APPLICATOR FOR APPLYING A PRODUCT TO KERATINOUS FIBERS

(75) Inventor: Jean-Louis H. Gueret, Paris (FR)

(73) Assignee: L 'Oreal S.A., Paris (FR)

( * ) Notice: Subject to any disclaimer, the term of this patent is extended or adjusted under 35 U.S.C. 154(b) by 0 days.

(21) Appl. No.: 10/084,976

(22) Filed: Mar. 1, 2002

(65) Prior Publication Data

US 2002/0124861 A1 Sep. 12, 2002

(30) Foreign Application Priority Data

Mar. 1, 2001 (FR) ..... 01 02799

(51) Int. Cl.[7] ..... A45D 40/26
(52) U.S. Cl. ..... 132/218; 132/200
(58) Field of Search ..... 132/218, 216, 132/120, 308, 313, 317, 320; 401/126, 127, 129, 122; 15/207.2, 160, 206; D4/131

(56) References Cited

U.S. PATENT DOCUMENTS

| | | | | |
|---|---|---|---|---|
| 565,328 A | | 8/1896 | Buhler | |
| 1,659,707 A | | 2/1928 | Rudolph et al. | |
| 1,742,929 A | * | 1/1930 | Ovtshenikoff | 15/160 |
| 1,806,520 A | | 5/1931 | Cave | |
| 1,939,996 A | * | 12/1933 | Lockwood | 15/167.1 |
| 1,962,854 A | | 6/1934 | Anderson | |
| 2,448,603 A | | 9/1948 | Kevin et al. | |
| 3,033,213 A | | 5/1962 | Joss et al. | |
| 3,214,782 A | | 11/1965 | Masters et al. | |
| 3,469,928 A | | 9/1969 | Widegren | |
| 3,892,248 A | * | 7/1975 | Kingsford | 132/218 |
| 3,908,675 A | | 9/1975 | Spatz et al. | |
| 3,908,676 A | | 9/1975 | Levine et al. | |
| 3,921,650 A | | 11/1975 | Montgomery | |
| 3,935,611 A | * | 2/1976 | Locher | 15/160 |

(List continued on next page.)

FOREIGN PATENT DOCUMENTS

| | | |
|---|---|---|
| DE | 42 05 935 | 9/1993 |
| EP | 0 511 842 | 11/1992 |
| EP | 0 663 161 | 7/1995 |
| EP | 1 020 136 | 7/2000 |
| FR | 726 157 | 5/1932 |
| FR | 2 285 101 | 4/1976 |
| FR | 2 505 633 | 11/1982 |
| FR | 2 605 505 | 4/1988 |
| FR | 2 678 494 | 1/1993 |
| FR | 2 701 198 | 8/1994 |

(List continued on next page.)

OTHER PUBLICATIONS

Co–pending Application No. 09/761,701; Attorney Docket No. 05725.0675–00000 Title: Brush Having a Plano–Concave Profile Inventor(s): Jean–Louis H. Gueret U.S. Filing Date: Jan. 18, 2001.

Co–pending Application No. 09/773,946; Attorney Docket No. 05725.0692–00000 Title: Brush Having Plano–Concave Profile Inventor(s): Jean–Louis H. Gueret U.S. Filing Date: Feb. 2, 2001.

(List continued on next page.)

*Primary Examiner*—Eduardo C. Robert
*Assistant Examiner*—David C. Comstock
(74) *Attorney, Agent, or Firm*—Finnegan, Henderson, Farabow, Garrett & Dunner, LLP

(57) ABSTRACT

An applicator for applying a product to keratinous fibers. The applicator may comprise a core curved about at least two axes that are not parallel to one another. The applicator may also comprise a plurality of application members extending from the core. The plurality of application members may be configured to apply the product to keratinous fibers.

113 Claims, 12 Drawing Sheets

U.S. PATENT DOCUMENTS

| | | | | | |
|---|---|---|---|---|---|
| 4,291,432 | A | * | 9/1981 | Cogswell | 15/160 |
| 4,365,642 | A | | 12/1982 | Costa | |
| 4,403,624 | A | | 9/1983 | Montgomery | |
| 4,458,701 | A | | 7/1984 | Holland | |
| 4,461,312 | A | | 7/1984 | Gueret | |
| 4,527,575 | A | | 7/1985 | Vasas | |
| 4,545,393 | A | | 10/1985 | Gueret et al. | |
| 4,561,456 | A | | 12/1985 | Gueret | |
| 4,586,520 | A | | 5/1986 | Brittain | |
| 4,632,136 | A | * | 12/1986 | Kingsford | 132/218 |
| 4,635,659 | A | | 1/1987 | Spatz | |
| 4,662,385 | A | | 5/1987 | Schefer | |
| 4,784,505 | A | | 11/1988 | Dahm | |
| 4,804,004 | A | | 2/1989 | Taylor | |
| 4,810,122 | A | | 3/1989 | Cole | |
| 4,887,622 | A | | 12/1989 | Gueret | |
| 4,898,193 | A | | 2/1990 | Gueret | |
| 4,921,366 | A | | 5/1990 | Hurrell | |
| 4,927,281 | A | | 5/1990 | Gueret | |
| 4,993,440 | A | | 2/1991 | Gueret | |
| 5,094,254 | A | | 3/1992 | Krueckel et al. | |
| 5,137,038 | A | | 8/1992 | Kingsford | |
| 5,197,497 | A | | 3/1993 | Gueret | |
| 5,224,787 | A | | 7/1993 | Vasas | |
| 5,238,011 | A | | 8/1993 | Gueret | |
| 5,309,929 | A | | 5/1994 | Toll | |
| 5,339,841 | A | | 8/1994 | Gueret | |
| 5,345,644 | A | | 9/1994 | Gueret | |
| 5,357,987 | A | | 10/1994 | Schrepf | |
| 5,418,999 | A | | 5/1995 | Smith | |
| 5,482,059 | A | | 1/1996 | Miraglia | |
| 5,542,439 | A | | 8/1996 | Gueret | |
| 5,551,456 | A | | 9/1996 | Hartel | |
| 5,595,198 | A | | 1/1997 | Kemmerer | |
| 5,613,258 | A | | 3/1997 | Hilfinger et al. | |
| 5,621,941 | A | * | 4/1997 | Liu | 15/106 |
| 5,709,230 | A | | 1/1998 | Miraglia | |
| 5,722,436 | A | | 3/1998 | Vandromme et al. | |
| 5,803,638 | A | | 9/1998 | Gueret | |
| 5,853,011 | A | | 12/1998 | Gueret | |
| 5,860,432 | A | | 1/1999 | Gueret | |
| 5,862,812 | A | * | 1/1999 | Dumler | 132/218 |
| 5,876,138 | A | | 3/1999 | Gueret | |
| 5,894,847 | A | | 4/1999 | Gueret | |
| 5,918,994 | A | | 7/1999 | Gueret | |
| 5,934,292 | A | | 8/1999 | Gueret | |
| 5,937,870 | A | | 8/1999 | Gueret | |
| 6,003,519 | A | | 12/1999 | Gueret | |
| 6,067,997 | A | | 5/2000 | Gueret | |
| 6,076,531 | A | | 6/2000 | Gueret | |
| 6,076,985 | A | | 6/2000 | Gueret | |
| 6,099,183 | A | | 8/2000 | Gueret | |
| 6,237,609 | B1 | | 5/2001 | Vasas | |
| 6,279,583 | B1 | * | 8/2001 | Neuner | 132/218 |
| 6,309,125 | B1 | * | 10/2001 | Peters | 401/127 |
| 6,341,913 | B1 | * | 1/2002 | Wilson-Jackson | 401/129 |
| 6,345,923 | B2 | | 2/2002 | Gueret | |
| 6,508,603 | B1 | * | 1/2003 | Vasas | 401/129 |
| 2002/0020426 | A1 | | 2/2002 | Gueret | |

FOREIGN PATENT DOCUMENTS

| | | |
|---|---|---|
| FR | 2 715 038 | 7/1995 |
| FR | 2 730 910 | 8/1996 |
| FR | 2 730 911 | 8/1996 |
| FR | 2 745 272 | 8/1997 |
| FR | 2 749 489 | 12/1997 |
| FR | 2 749 490 | 12/1997 |
| FR | 2 755 593 | 5/1998 |
| FR | 2 798 267 | 3/2001 |
| FR | 2 811 525 | 1/2002 |
| GB | 1 335 322 | 10/1973 |
| GB | 2 146 520 | 4/1985 |
| GB | 2 170 996 | 8/1986 |
| GB | 2 174 895 | 11/1986 |
| JP | 56-91507 U | 12/1954 |
| JP | 58-88912 U | 6/1983 |
| JP | 63-111808 | 5/1988 |
| JP | 5-88410 U | 12/1993 |
| JP | 6-237818 | 8/1994 |
| JP | 8-335518 | 2/1996 |
| WO | WO 93/16617 | 9/1993 |
| WO | WO 96/29905 | 10/1996 |

OTHER PUBLICATIONS

Co–pending Application No. 09/867,646; Attorney Docket No. 05725.0707–00000 Title: Brush Having for Applying a Cosmetic Product and Make–Up Device Comprising It Inventor(s): Jean–Louis H. Gueret U.S. Filing Date: May 31, 2001.

Co–pending Application No. 10/084,975; Attorney Docket No. 08048.0026–00000 Title: Brush for Applying Product to Keratinous Fibers Inventor(s): Jean–Louis H. Gueret U.S. Filing Date: Mar. 1, 2002.

Co–pending Application No. 10/084,939; Attorney Docket No. 08048.0027–00000 Title: Brush and Method of Making Brush Inventor(s): Jean–Louis H. Gueret U.S. Filing Date: Mar. 1, 2002.

English language Derwent Abstract of DE 42 05 935, Sep. 2, 1993.

English language translation of FR 726 157.

English language Derwent Abstract of FR 2 285 101, Apr. 16, 1976.

English language Derwent Abstract of FR 2 678 494, Jan. 8, 1993.

English language Derwent Abstract of FR 2 798 267, Mar. 16, 2001.

English language Derwent Abstract of EP 1 020 136, Jul. 19, 2000.

* cited by examiner

APPLICATOR FOR APPLYING A PRODUCT TO KERATINOUS FIBERS

The present invention relates to an applicator for applying a cosmetic and/or a care product to keratinous fibers, for example, applying mascara to eyelashes. The present invention also relates to a system for applying a product to keratinous fibers, a method of applying a product to eyelashes, and a method of manufacturing an applicator.

Numerous applicators are known that comprise a rectilinear core formed by two twisted-together strands of metal wire holding tufts of bristles between them. Applicators are also known in which the core is curved about an axis. In such known curved-core applicators, however, the core as a whole lies in a single plane of curvature.

There exists a need for an applicator that provides improved quality of makeup, ease-of-use, improved product loading, as well as improved elongation, curving, separation, and penetration of the application members amongst the eyelashes.

In accordance with the purpose of the invention, as embodied and broadly described herein, the invention includes an applicator for applying a product to keratinous fibers. The applicator may comprise a core curved about at least two axes that are not parallel to one another. The applicator may also comprise a plurality of application members extending from the core. The plurality of application members may be configured to apply the product (e.g., mascara) to keratinous fibers (e.g., eyelashes). The plurality of application members may be, for example, bristles or teeth.

In an aspect, the core of the applicator may be curved about at least two axes that extend in directions perpendicular to one another.

In another aspect, the applicator may be made by curving the core of a blank having an envelope surface substantially circularly symmetrical about the axis of the core over at least a portion of a length of the blank.

The term "envelope surface" as used herein refers to an imaginary surface defined by ends of at least some of the application members extending from the core of the applicator or blank. For example, the envelope surface could be considered to be the three dimensional image seemingly formed by the application member ends when the applicator/blank is viewed by an observer. When there are a mixture of shorter application members and longer application members extending in substantially the same direction at substantially the same axial position on the core, the ends of the longer application members may define the envelope surface, while the ends of the shorter application members may be beneath that surface.

As used herein, the term "blank" refers to a partially-manufactured applicator or a part of an applicator that may be subjected to one or more additional manufacturing steps before becoming a completed applicator. For example, the term "blank" may be used herein to refer to an applicator that has a core that has not yet been curved.

The term "providing" is used in a broad sense, and refers to, but is not limited to, making available for use, enabling usage, giving, supplying, making, obtaining, getting a hold of, acquiring, purchasing, selling, distributing, possessing, making ready for use, and/or placing in a position ready for use.

In a further aspect, the applicator may be made from a blank comprising at least one notch and/or facet. For example, the blank may comprise at least one substantially planar facet. Additionally, the applicator could comprise at least one notch having a cross-section that is outwardly concave in shape. The notches and/or facets may have other shapes as well.

As used herein, the term "cross-section" relates to a cross-section taken in a plane perpendicular to the axis of the core.

In still another aspect, the blank used to make the applicator may comprise an odd number of facets and/or notches. For example, the blank may comprise three facets and/or three notches. Optionally, the blank may be substantially prismatic-shaped over at least a portion of a length of the blank. The blank could also have a cross-section substantially triangular over at least a portion of a length of the blank. The number of facets and/or notches could also be different.

As used herein, cross-sections that are "not geometrically similar" satisfy at least one of the following two conditions: 1) the cross-sections have shapes differing from one another in other than scale magnitude (e.g., one cross-section is not a scale magnification or scale demagnification of another cross-section; the cross-sections may be shaped analogous to non-homothetic figures); and 2) the cross-sections have differing ratios of a to b, wherein a is the longest distance from the axis of the core to the outer boundary of the cross-section and b is the shortest distance from the axis of the core to the outer boundary of the cross-section. When the axis of the core is located at the center of a circular shaped cross-section, the ratio of a to b is one.

As used herein, the term "circularly symmetrical" relates to a configuration having a circular shaped cross-section, wherein the axis of the core passes through the center of the circular shaped cross-section.

In yet another aspect, the applicator may be made from a blank having a cross-section that varies over at least a portion of a length of the blank. For example, the variance of the cross-section of the blank may be "not geometrically similar." The cross-section of the blank may also be non-symmetrical relative to a plane perpendicular to the plane of curvature of the core at one or more points after the core has been curved about a first axis. In an embodiment, the cross-section of the applicator may be non-symmetrical relative to a plane perpendicular to the plane of curvature over at least a portion of the applicator along which the cross-section varies in a manner that is not geometrically similar.

In an aspect, the core of the blank used to make the applicator may be curved about a first axis and a second axis. After the core of the blank is curved about the first axis, a cross-section of the blank may be non-symmetrical about a plane perpendicular to the plane of curvature of the core at the point of cross-section.

As used herein, the term "plane of curvature" means a plane that is perpendicular to an axis about which the core of a blank/applicator is curved and that contains at least the curved portion of the axis of the core. When a core is curved about two or more axes not parallel to one another, the core will have multiple planes of curvature.

In another aspect, the applicator may comprise a portion including one of a notch and a facet. When the core of the applicator is straightened such that it is substantially rectilinear, a width of the notch or facet may pass through a maximum point (i.e., maximum width) between ends (e.g., longitudinal ends) of the notch or facet.

In still another aspect, the applicator may be made from a blank having an envelope surface of any shape. For example, the blank used to make the applicator may have an envelope surface that is substantially peanut-shaped, substantially bullet-shaped, substantially buoy-shaped, substantially fish-shaped, substantially hourglass-shaped, and/or substantially football-shaped. Alternately, the blank may have an envelope surface that has other shapes.

In yet another aspect, the applicator may be made from a blank having a cross-section that passes through at least one extreme value (e.g., maximum width/length/diameter) between axial ends of the applicator.

Optionally, the core may be located off-center with respect to the envelope surface of the applicator over at least a portion of a length of the core.

In another aspect, the applicator may further comprise a stem and the core may be at an end of the stem.

The applicator may further comprise a handle at the end of the stem opposite from the core.

When the application members include bristles, the ends of the bristles may define helical sheets. The core may be curved so as to reduce an angle of inclination of the helical sheets relative to an axis of the stem as the distances from the helical sheets to the stem increases.

In a further aspect, the plurality of application members may comprise bristles of different lengths. For example, the plurality of application members may comprise shorter bristles and longer bristles. The shorter bristles optionally may be contained within a volume defined by an envelope surface defined by the longer bristles.

In an aspect, the core may be twisted. In an embodiment, the core may be a twisted wire core having a left-hand or a right-hand pitch, e.g., a left-hand pitch as described in patent application No. FR-A-2,701,198. Alternatively, the core may not be twisted.

In a core with a left-hand pitch, the strands of the core may be twisted by turning to the left to form turns which, when viewed along the axis of the core from an end fixed to a stem, turn clockwise from the stem towards the free end of the brush.

The core may be curved for a left-hand pitch in such a manner as to reduce the inclination of the helical sheets formed by the application members relative to the axis of the stem as the helical sheets move further away from the stem, thus making it possible to improve separation between the eyelashes at the ends of the eyelid by increasing the angle between the eyelashes and the sheets of application members.

When the applicator has a right-hand pitch, the curvature of the core may make it possible to modify the way in which the sheets of application members are oriented in order to obtain a desired makeup result.

In still another aspect, the core may be curved such that an axis of the stem and any line tangent to an axis of the core do not extend in directions perpendicular to one another.

In an additional aspect, the core may be curved such that the curved portion of the core defines at least two arcs each having ends and a center of curvature, and wherein each of the at least two arcs defines an angle having a vertex defined by the center of curvature and legs defined by lines connecting ends of the arc to the center of curvature, the angle being less than 90°.

In another aspect, the scalar product of the directive vector of the axis of the stem and the directive vector of any point along the axis of the core may be positive.

In a further aspect, the invention may include an applicator for applying a product to keratinous fibers comprising a core and a plurality of application members extending from the core. The plurality of application members may be configured to apply the product to keratinous fibers (e.g., eyelashes). The core may be curved such that an axis of the core does not lie entirely in any single plane.

In a further aspect, the invention may include a system for applying a product to keratinous fibers. The system may comprise an applicator and a receptacle for containing a product. The system may further comprise a product in the receptacle, for example, a hair product such as mascara.

In another aspect, the system may comprise a wiper for wiping product from the applicator. Optionally, the wiper may be on the receptacle.

The applicator in the system may comprise a handle with the core coupled to an end of the handle. The applicator may also comprise a stem with the core at a first end of the stem and the handle at a second end of the stem.

In still another aspect, the system may comprise a cap for the receptacle. For example, the handle may be configured to be a cap for the receptacle.

In an aspect, the system may be configured such that at least a portion of the applicator is capable of being stored in the receptacle.

The invention may also include a method of applying a product to eyelashes. The method may comprise providing a system for applying a product to keratinous fibers, loading the applicator with a supply of product from the receptacle, and applying the product to eyelashes with the applicator. The product may be, for example, a supply of hair product such as mascara.

When the system comprises a wiper, the method may further comprise wiping excess product from the applicator with the wiper.

In an aspect, the loading of the product may comprise inserting at least a part of the applicator into the receptacle.

Optionally, the system may comprise a wiper on the receptacle, and the method may comprise wiping the applicator with the wiper when the applicator is withdrawn from the receptacle.

The applicator of the invention may make it possible to load product non-uniformly onto application members (e.g., bristles) because at least some portions of the applicator may be off-axis (e.g., not centered) with respect to an axis of a handle and/or stem to which the core of the applicator may be connected, and optionally off-axis relative to the axis of a wiper as well. This configuration may enable the user to locally load an additional supply of product on the applicator that may enable the eyelashes to be loaded locally with an additional quantity of product and may also make it possible to obtain portions of the applicator that are more thoroughly wiped and suitable for separating the eyelashes, for example, the small eyelashes located at the ends of the eyelid.

When an end of the applicator remote from the stem has a cross-section eccentric (e.g., off center) relative to the axis of the stem and when the applicator passes through a relatively rigid wiper matching the diameter of the stem, the applicator may be able to flex on going through the wiper. As soon as the applicator has gone past the wiper, it may return to an initial configuration by moving transversely, which may have the effect of removing excess product at the end of the applicator. This feature may reduce the risk of dropping product from the free end of the applicator brush, which could be undesirable during application.

It may also be possible to make an applicator that is somewhat ergonomic and that may enable the eyelashes to be made up in satisfactory manner with the applicator occupying numerous positions relative to the eyelashes.

Because of the curvature of the portion of the core that supports the application members, the applicator may make it possible to impart a lateral oscillating motion to the application members when the applicator is rotated about an axis of the stem, thereby facilitating the penetration of the application members between the eyelashes and the taking hold of them.

The applicator may have a profile that varies while it is being rotated about the axis of its optional stem, such that the effects produced by the applicator on the eyelashes may differ depending on which region of the applicator comes into contact with the eyelashes. The applicator may have different portions suitable for exerting specific actions on the eyelashes.

The curvature imparted to the core may be selected as a function of the nature of the product, the application characteristics desired therefor, and/or the orientation to be given to the application members relative to the eyelashes at the instant of application.

In yet another aspect, the invention may include a method of manufacturing an applicator for applying a product to keratinous fibers. The method may comprise providing a blank having a core and application members configured to apply a product to keratinous fibers (e.g., eyelashes). The method may also comprise curving the core about a first axis and curving the core about a second axis. The first and second axes may be non-parallel to one another.

In one exemplary method, the core of the blank may be rectilinear (e.g., substantially straight).

In an aspect, the blank may have at least one substantially planar side face, and the curving of the core about one of the first and second axes may cause the substantially planar side face to become one of substantially concave and substantially convex.

In still another aspect, the blank may have at least one substantially concave side face, and the curving of the core about at least one of the first and second axes may cause the substantially concave side face to become substantially planar.

In another aspect, the blank may have at least one substantially convex side face, and the curving of the core about at least one of the first and second axes may cause the substantially convex side face to become substantially planar.

Optionally, the curving of the core about one of the first and second axes may comprise curving the core in a plane of curvature constituting a midplane of symmetry for the side face.

In a further aspect, the blank may have a substantially rectilinear edge, and the curving of the core about at least one of the first and second axes may cause the substantially rectilinear edge to become curved.

In an additional aspect, the blank may have a curved edge, and the curving of the core about at least one of the first and second axes may cause the curved edge to become substantially rectilinear.

The curving of the core about one of the first and second axes may optionally comprise curving the core in a plane of curvature containing the curved or substantially rectilinear edge.

The blank used for making the applicator may have various shapes, such as the shape of a cylinder, a peanut, a buoy, a fish, an hourglass, and/or a football. The blank may also optionally comprise at least one facet and/or at least one notch.

The blank may have a non-rectilinear edge and may be asymmetrical about a midplane of the blank. Optionally, the curving of the core about one of the first and second axes may substantially straighten out a part of the non-rectilinear edge or may causes the non-rectilinear edge to become substantially rectilinear.

When notches are cut in the envelope surface, they can present cross-sections that are outwardly concave in shape, for example.

In an embodiment, if the core of the applicator has been straightened out and made rectilinear for observation purposes, the applicator may include a portion that is provided with at least one facet and/or notch of a width that passes through a maximum going from one axial end of the facet or notch to the other.

The applicator may be made from a blank that is generally peanut-shaped and, in an embodiment, the blank may have at least one substantially plane face on one side of the brush (e.g., at least three substantially plane faces disposed in a triangular configuration about the axis of the core).

The blank may be machined to form facets and/or notches prior to the curving of the core.

The core may be eccentric (e.g., off center) with respect to a cross section of the blank/applicator over at least a portion of the length of the applicator before and/or after the core is curved.

Different types of application members may be used, such as bristles and/or teeth. In an embodiment, the applicator could be molded integrally with bristles and/or teeth.

The applicator may have application members (e.g., bristles) of different lengths. For example, it may have shorter bristles contained in the volume defined by the envelope surface defined by bristles of larger size.

The application members may receive any conventional treatment or processing. For example, the tips of the application members may be rounded and/or the ends of the application members may be forked.

It may be possible to use a mixture of different types of application members. For example, some or all of the application members may be hollow, may have a capillary groove, and/or may have zones of preferred deformation. The application members may also be corkscrew-shaped and/or flat. Other types of application members may be used as well.

Along at least a portion of a length of the applicator, a cross-section of the applicator may include steps.

The axis of the applicator may be at an angle in relation to an axis of an optional handle and/or stem in the vicinity of the handle and/or stem. In an embodiment, the core may be bent at a sharp angle in the vicinity of the portion of the core that is received in the optional handle or stem.

In an aspect, the method may comprise making the blank, which may include performing one or more steps in the manufacture of the blank.

The axes about which the core may be curved can extend in directions that are mutually perpendicular and that optionally intersect. Optionally, the axes of curvature may be contained in planes of symmetry for certain portions of the applicator.

The applicator may be made by bending the core of a blank having a an envelope surface that is a body of revolution over at least a portion of its length in such a manner as to change the shape of the envelope surface over the portion.

The applicator can optionally be made from a blank in which one or more notches and/or one or more facets have been cut. The facets may be substantially planar and optionally may be substantially parallel to the core of the blank or at an angle relative thereto.

The blank (which might sometimes be in the form of a starting applicator) can include at least one side face that is substantially planar, concave, and/or convex. The blank may optionally include an edge that is substantially rectilinear or curved. The curvature imparted during the steps of curving the core may seek: (a) to cause the side face to become concave or convex if it was initially substantially plane, or to cause it to become planar if it was initially concave or convex; or (b) to make the edge curved if it was initially substantially rectilinear, or substantially rectilinear if it was initially curved.

In an embodiment, the core may be curved in a plane of curvature constituting a midplane of symmetry for a face that contains an edge of the applicator.

The blank used for making the applicator can optionally be circularly symmetrical in shape, for example, it can be cylindrical, peanut-shaped, buoy-shaped, fish-shaped, hourglass-shaped, and/or football-shaped. The blank may also have one or more facets and/or notches cut in the blank.

The blank may be asymmetrical in shape about a midplane optionally perpendicular to the core or a midplane containing the axis of the blank.

The blank can also have a non-rectilinear edge when observed in a direction perpendicular to the axis of the optional handle and/or stem, and the curving of the core may have the effect of making the edge substantially rectilinear, or at least of straightening it out at least in part.

The core of the applicator may be curved such that the curvature is not constant along a length of the core at the end of the first curving step and prior to the second curving step. For example, the core may have both a rectilinear portion and a curved portion after curving it about the first axis and prior to curving it about one or more additional axes.

The invention may also include an applicator manufactured by one or more of the methods described herein.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic view of a blank from which an exemplary embodiment of an applicator could be made;

Reference will now be made in detail to exemplary embodiments of the invention, examples of which are shown in the drawings. Wherever possible, the same reference numbers are used in the drawings and the description to refer to the same like parts.

Figure 1:
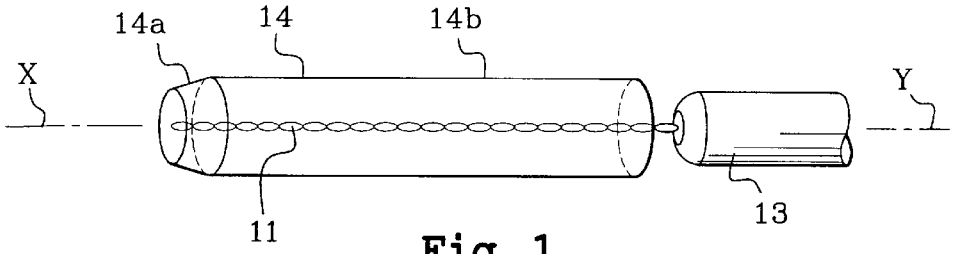
Figure 2:
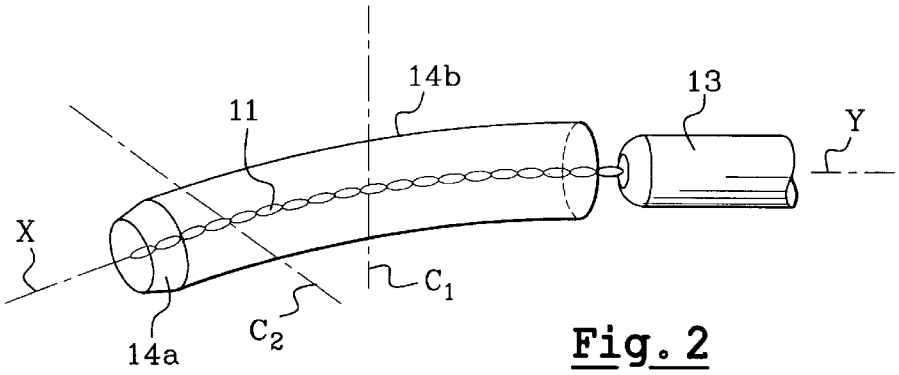
FIG. 2 is a schematic view of the blank of FIG. 1 curved about a first axis.
Figure 3:
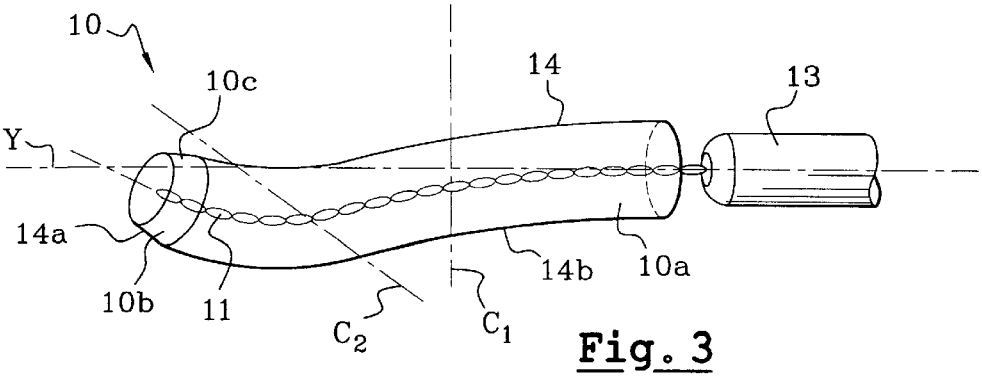
FIG. 3 is a schematic view of an applicator made by curving the blank of FIG. 2 about a second axis that is not parallel to the first axis.

FIGS. 1–3 show a first embodiment of the invention. FIG. 3 shows a schematic view of a finished applicator 10. The applicator 10 may comprise a core 11 (e.g., one or more strands of metal wire twisted together forming turns between which tufts of bristles may be retained). Application members are not shown in FIGS. 1–3 for the sake of clarity. The applicator 10 has an envelope surface 14 defined by the free ends of the longest application members (not shown) at each point along the core.

The core 11 optionally may be coupled at one end to a stem 13 having an axis Y. The stem 13 may be made of plastic material and the core 11 may be forced into a housing provided at a distal end of the stem 13. Alternately, the stem 13 and the core 11 may be coupled by any other suitable means and may be made of any appropriate materials.

The envelope surface 14 of the blank shown in FIG. 1 may comprise a tapering distal end portion 14*a* on the same axis X as the core 11 (when the core is initially rectilinear) and a circularly cylindrical portion 14*b* located about the axis X.

The blank of FIG. 1 can be changed into the form of the blank of FIG. 2 by curving the core 11 about a first axis C1. The axis C1 may be contained in a midplane of the blank of FIG. 1. The axis C1 may also extend in a direction perpendicular to the axis X and optionally may intersect the core halfway along the blank. After the core 11 has been curved about the axis C1, the portion 14*a* may remain tapered whereas the portion 14*b* may become a portion of a torus, for example.

The core 11 of the blank of FIG. 2 may lie in a plane of curvature perpendicular to the axis C1.

To convert the blank of FIG. 2 into the applicator shown in FIG. 3, the core 11 may be curved in a plane of curvature lying outside of the initial plane of curvature after curving the core about the first axis. For example, the core 11 may be curved about an axis C2, which optionally is substantially perpendicular to the axis C1. The axis C2 may intersect the axis C1 or it may merely extend in a direction perpendicular to the direction in which axis C1 extends. Thus, the axis C2 may not lie in the plane of curvature of the blank of FIG. 2, but can be located at an angle relative thereto.

The proximal end portion 10*a* of the applicator 10 (see FIG. 3) may be located substantially in line with the axis Y of the stem 13 so that the end portion 10*a* may be wiped in a relatively uniform manner. Alternately, the applicator 10 may have a distal end portion that is more complex in shape and that may be wiped in non-uniform manner when using the applicator in combination with a wiper.

The off-center region 10*b* of the distal end portion 14*a* furthest from the axis Y may be wiped relatively thoroughly, while the diametrically opposite region 10*c* may be wiped less thoroughly or even not at all since the region 10*c* is close to the axis Y and its distance from the axis Y may be less than or equal to the diameter of the orifice of a wiper. Alternately, the distance between the region 10*c* and the axis Y may be slightly greater than the diameter of the orifice.

The core 11 of the applicator 10 may be curved such that the core 11 does not lie entirely in any one single plane.

The applicator may include a portion capable of being loaded with a relatively large supply of product, which may be helpful in putting extra product onto the eyelashes locally, and another portion wiped well that can be used for combing and separating the eyelashes.

When the product is applied to the eyelashes while turning the brush about the axis Y of the optional stem 13, the application members in the off-center region 10*b* may oscillate transversely relative to the axis Y, which may facilitate penetration of the application members (e.g., bristles) between the eyelashes and can improve the way in which the eyelashes are held by the applicator.

In the exemplary applicator of FIG. 3, the radius of curvature of the core 11 may be relatively large. However, without going beyond the ambit of the present invention, it may be possible to curve the core about a radius of curvature that is much smaller, for example, so as to form a zigzag line.

Figure 4:
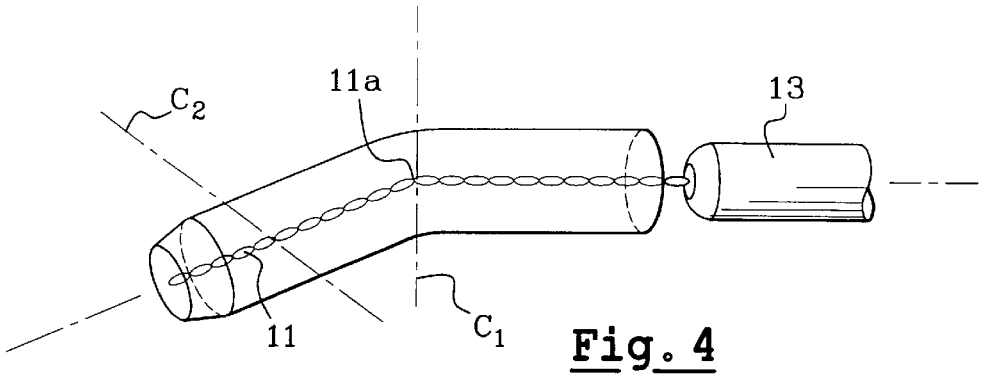
FIG. 4 is a schematic view of a blank having a core curved about a first axis from which another exemplary embodiment of an applicator could be made.
Figure 5:
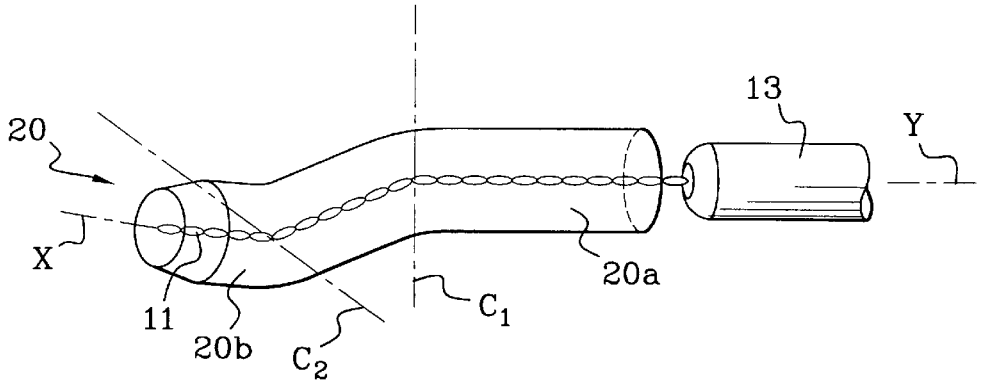
FIG. 5 is a schematic view of an applicator made by curving the core of FIG. 4 about a second axis that is not parallel to the first axis.

FIG. 5 shows an applicator 20 made from a cylindrical blank of the kind shown in FIG. 1. As shown in FIG. 4, the core 11 of the applicator 20 has been curved a first time with a relatively small radius of curvature about a first axis C1 to form two straight-line segments (i.e., one proximal and one distal). Thereafter, the distal segment may be subjected to a second curvature about an axis C2 so as to direct the distal end portion of the applicator in a direction that extends away from the plane of curvature of the core shown in FIG. 4 (e.g., so that the axis of the core does not lie entirely in a single plane).

The applicator 20 may have a proximal end portion 20*a* lying substantially on the axis of the stem 13, which may be wiped uniformly when the applicator is used in combination with an optional wiper. The applicator 20 may also have a distal end portion 20*b* offset from the axis Y, which may be wiped in a non-uniform manner, like the off-center region 10*b* of the applicator 10 of FIG. 3.

In the exemplary embodiments shown in FIGS. 1 to 5, the blank may be generally circularly symmetrical in shape. It would not go beyond the ambit of the present invention, however, to make an applicator from a blank having an initial shape more complicated. For example, the blank may include one or more facets or notches, and/or at least one portion along its length that is not circular in cross-section. Optionally, the blank may be prismatic shaped and/or have a triangular-shaped cross-section.

Figure 6:
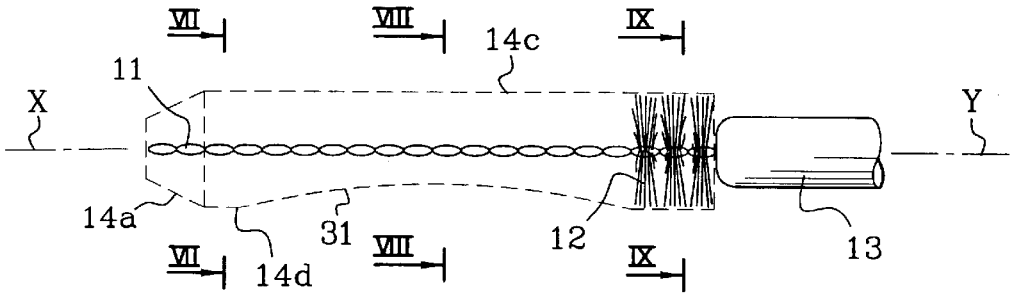
FIG. 6 is a schematic view of a blank from which still another exemplary embodiment of an applicator could be made.
Figure 11:
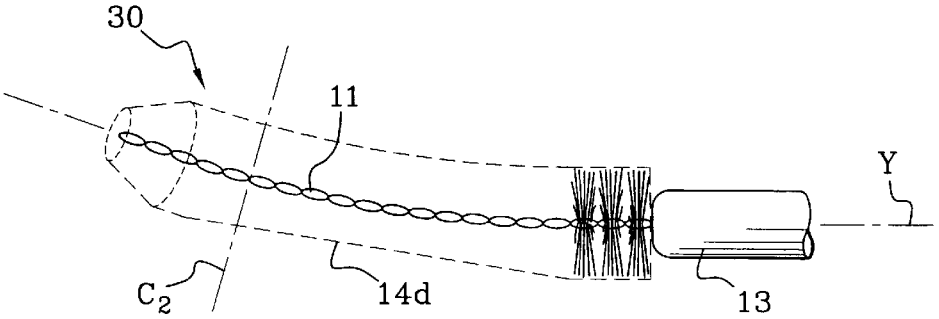
FIG. 11 is a schematic view of an applicator made by curving the core of FIG. 10 about a second axis that is not parallel to the first axis.

FIGS. 6–11 show the manufacture of a brush 30, which is shown in a finished state in FIG. 11. FIG. 6 shows a blank that includes a notch 31 used to make the applicator. The notch 31 may be made in a blank having a body that is initially a circular cylinder (e.g., of the kind shown in FIG. 1). The bottom wall 14*d* of the notch 31 may be defined by a cylindrical surface portion having a directrix defined by a circular arc contained in the plane of FIG. 6 and having a generator line perpendicular to the plane of FIG. 6. For the sake of clarity, FIG. 6 shows only a few application members 12 (e.g., bristles) extending from the core 11 (e.g., held between turns of the core 11).

The envelope surface of the FIG. 6 applicator may be defined by the tapering envelope portion 14*a* in combination with an envelope portion 14*c* that may be substantially circularly cylindrical except for the bottom wall 14*d* of the notch 31.

Figure 7:
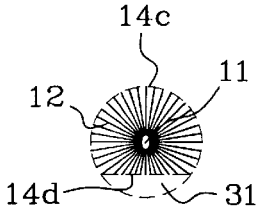
FIGS. 7–9 are views of a cross-section of the blank of FIG. 6 taken along planes VII—VII, VIII—VIII, and IX—IX respectively.
Figure 8:
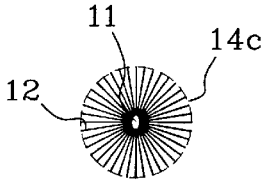
Figure 9:
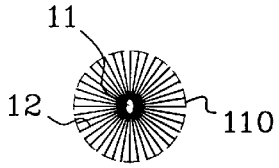
Figure 10:
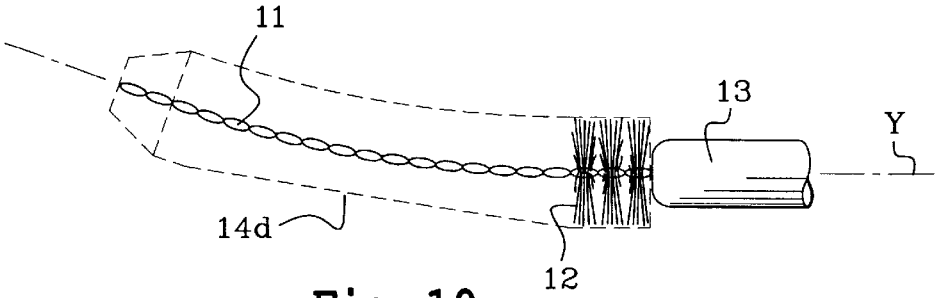
FIG. 10 is a schematic view of the blank of FIG. 6 having a core curved about a first axis.

FIGS. 7 to 9 show various cross-sections of the blank of FIG. 6 taken along section planes VII—VII, VIII—VIII, and IX—IX.

To make the applicator 30 of FIG. 11, the core 11 of the blank of FIG. 6 may be curved about an axis perpendicular to the plane of FIG. 6, located on the opposite side from the notch 31, close to a midplane of symmetry for the notch 31, and substantially perpendicular to the axis X of the core. The curving may result in a flattening of the notch 31 and may give the brush an outwardly concave shape on its side diametrically opposite from the notch 31 (see FIG. 10). Thereafter, in order to convert the blank of FIG. 10 into the applicator 30 of FIG. 11, the core 11 may be curved about a second axis C2, which may be parallel to the plane of FIG. 10 (i.e., parallel to the plane of curvature of the core 11 of the blank of FIG. 10). The axis C2 may be contained in a plane perpendicular to the core 11 and may intersect the core 11 about one-fourth of the way from its free end.

It will be understood that in order to make an applicator in accordance with the invention it is possible to start with blanks having a very wide variety of shapes.

Figure 12:
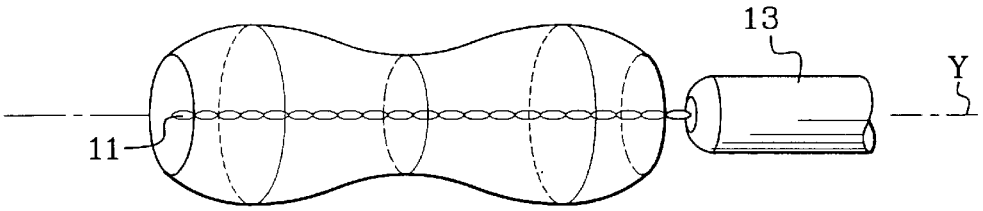
FIG. 12 is a schematic view of a blank having a peanut-shape.
Figure 13:
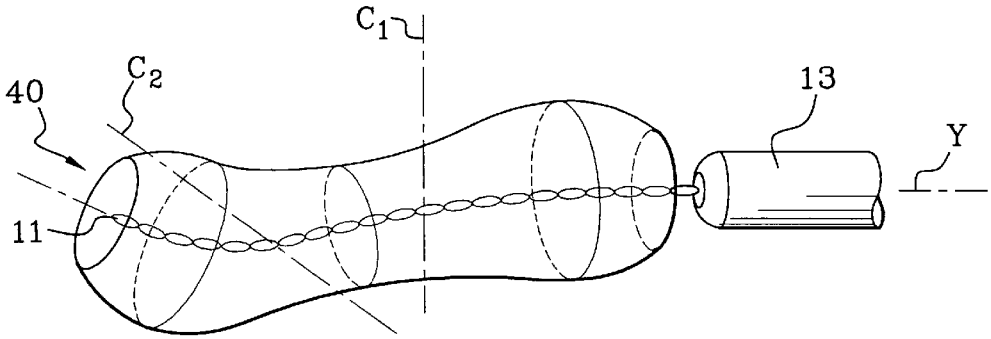
FIG. 13 is a schematic view of an applicator made from the blank of FIG. 12.

Referring to FIG. 13, an applicator 40 may be made with the substantially peanut-shaped blank shown in FIG. 12. The blank of FIG. 12 is generally in the form of a circularly symmetrical body of diameter that passes through a minimum between two swollen portions, namely, a proximal portion adjacent to the stem 13 and a distal portion located beside the free end of the blank. To obtain the applicator 40, the blank of FIG. 12 may have its core 11 curved in substantially the same manner as the curving of the blank of FIG. 1 to form the applicator 10 of FIG. 3.

Figure 14:
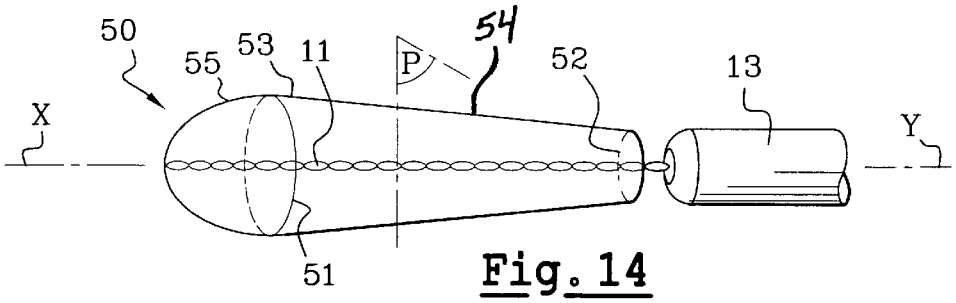
FIGS. 14–17 are schematic views of blanks having various shapes.

Referring to FIG. 14, the blank 50 is substantially bullet-shaped. The blank 50 is non-symmetrical relative to a midplane P that is perpendicular to the core 11 and intersects the core 11 halfway along the blank 50. The blank 50 may be generally circularly symmetrical about the axis X of the core 11 (shown as rectilinear). The envelope surface of the blank 50 passes through a maximum diameter at a maximum diameter circle 51. The body of the blank 50 may be frustoconical, wherein it has its larger base coinciding with the maximum diameter circle 51, where it joins to the distal end portion of the blank that is bullet-shaped.

Figure 15:
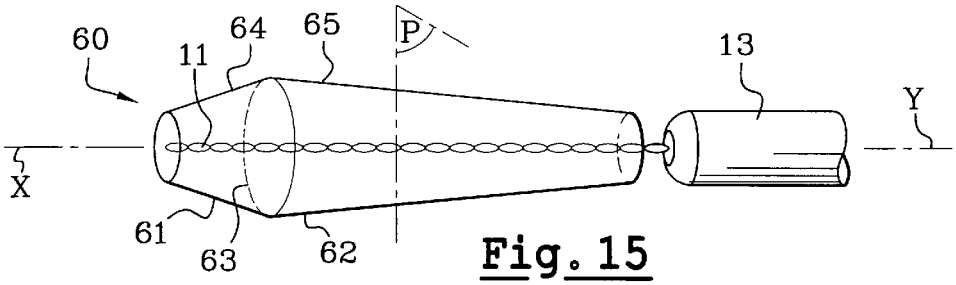

The blank 60 shown in FIG. 15 is generally buoy-shaped and may be circularly symmetrical about the axis X of the rectilinear core 11. The envelope surface of the blank 60 may be defined by two frustoconical portions 61 and 62, which meet at their larger diameter bases 63.

Figure 16:
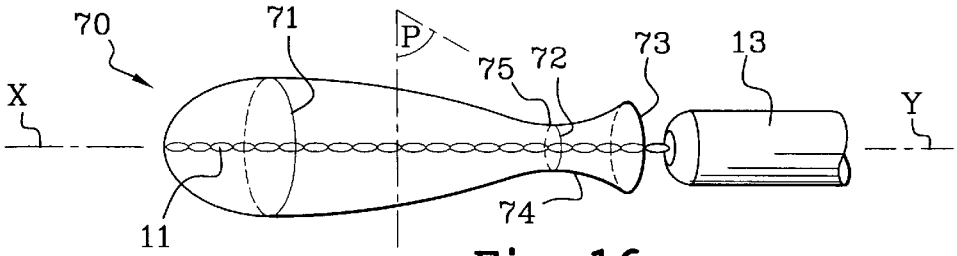
Figure 17:
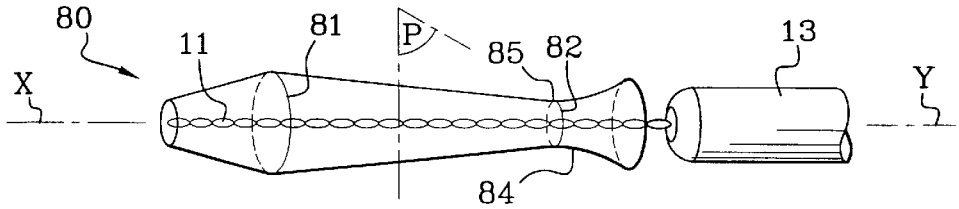

Referring to FIGS. 16 and 17, the blanks 70 and 80 are generally fish-shaped and may be circularly symmetrical about the axis X of the rectilinear core 11. The diameter of the blank 70 shown in FIG. 16 may reach a maximum at a maximum diameter circle 71, which may be located about one-fourth of the way from the free end of the blank 70. The diameter of the blank 70 may pass through a minimum in a narrowed portion 72 located between the maximum diameter circle 71 and the end 73, which is adjacent to the stem 13, and which is located substantially three-fourths of the way along the brush, in the example shown.

The blank 80 shown in FIG. 17 differs from the blank 70 shown in FIG. 16 in that the shape of the distal end portion of the blank 80 located between the maximum diameter circle 81 and the free end is frustoconical. The blank 80 also differs from the blank 70 by the fact that the diameter of the applicator decreases substantially linearly between the circle 81 and the narrowed portion 82.

Figure 37:
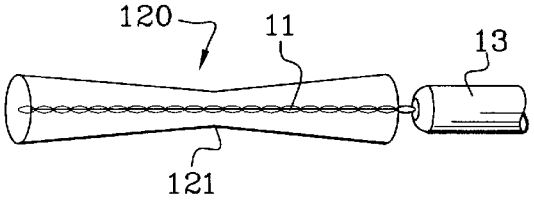
FIGS. 37 and 38 are schematic views of blanks from which exemplary embodiments of an applicator could be made.

Referring to FIG. 37, the blank 120 may be generally hourglass-shaped and may have a diameter that passes through a minimum between the two axial ends of the brush.

Figure 38:
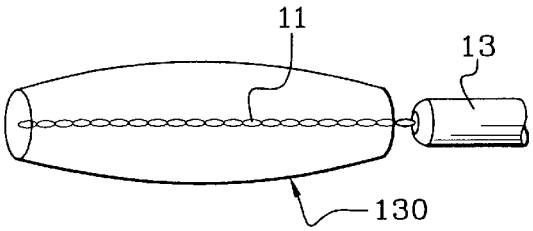

The blank 130 shown in FIG. 38 may generally be in the shape of a football.

Applicators in accordance with the invention may be made from blanks shown in FIGS. 14–17 and 37–38 by curving the core 11 of the blank about at least two axes that are not mutually parallel. The first curve may have the purpose of straightening out (at least in part) a non-rectilinear edge of the blank, so as to make it straight or at least less indented. The non-rectilinear edge to be straightened may be a top edge or a bottom edge of the blank when the blank is observed in a direction perpendicular to the axis X of the core 11.

Figure 18:
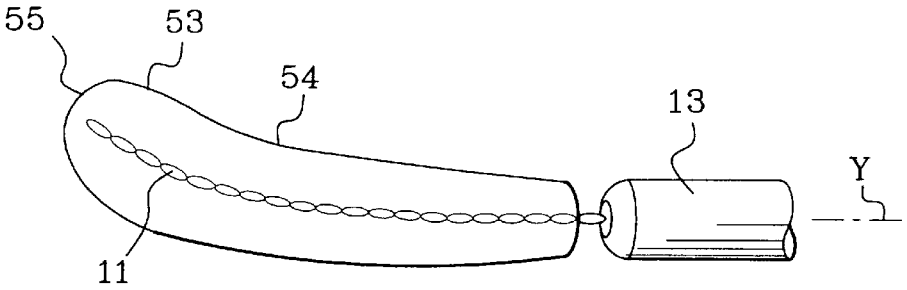
FIGS. 18–21 are schematic views of the blanks of FIGS. 14–17, respectively, with their cores curved about a first axis.

Referring to FIG. 14, the edge to be straightened may be the top edge 53 of the blank 50 in the vicinity of its maximum diameter circle 51. The edge 53 may include an elliptical arc 55 and a generator line 54 for the body of the blank. The result of curving the core 11 about a first axis may be to straighten out the top edge 53 so as to bring a portion of the arc 55 into line with the generator line 54, as shown in FIG. 18.

Figure 19:
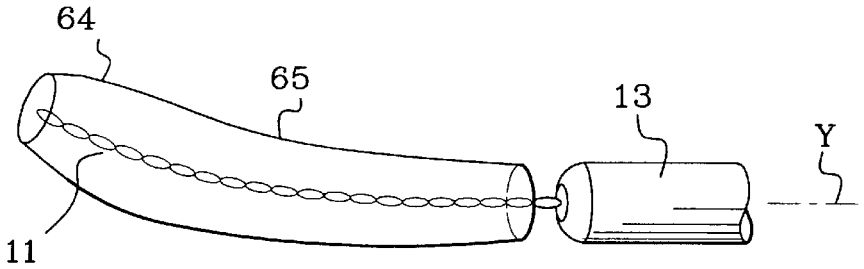

Referring to the blank 60 of FIG. 15, one of the two curves imparted to the core may have the result of bringing the generator lines 64 and 65 (constituting the top edge of the blank) substantially into line with each other, as shown in FIG. 19.

Figure 20:
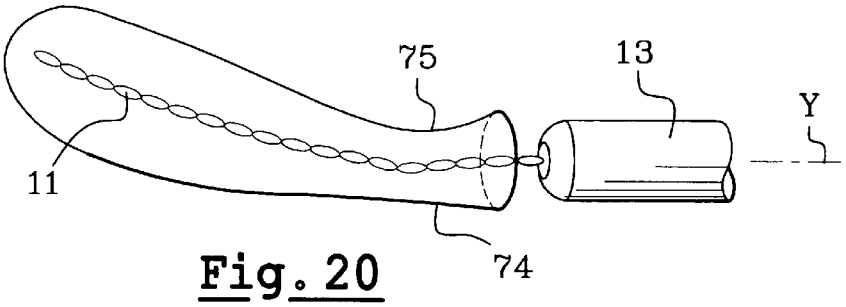
Figure 21:
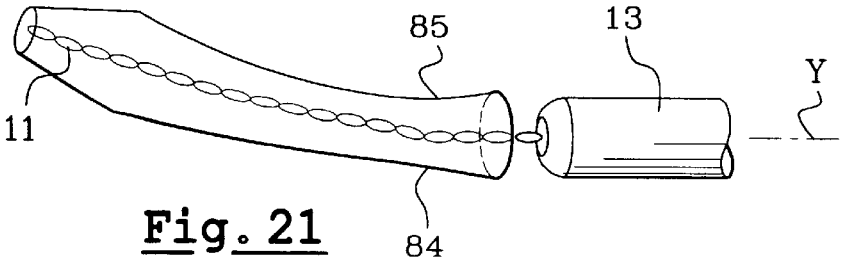

For the blanks shown in FIGS. 16 and 17, curving the core about one of the axes may have the effect of flattening the concave bottom edge 74, 84 or top edge 75, 85 that defines the bottom or top of the narrowed portion 72, 82, as shown in FIGS. 20 and 21.

For the blank 120 of FIG. 37, curving the core about one of the axes may straighten the edge in the form of a reentrant angle 121 where the two truncated cones join, so as to make it substantially rectilinear.

Before curving the core, it may be possible to machine one or more facets on the blank. These facets can be substantially planar and may be parallel to the core 11. The facets also may have the effect of causing the core to lie off-center.

Figure 22:
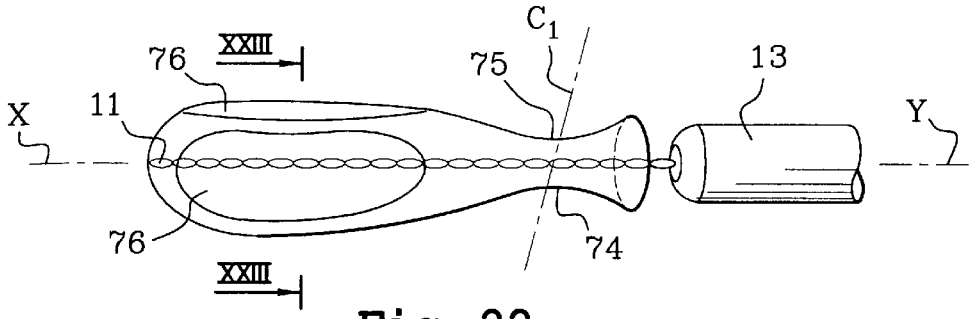
FIG. 22 is a schematic view of the blank of FIG. 16 with facets.
Figure 23:
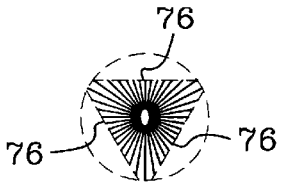
FIG. 23 is a view of a cross-section of the blank of FIG. 22 taken along plane XXIII—XXIII.

FIG. 22 shows the blank of FIG. 16 with three facets 76 cut therein. The facets 76 may be substantially planar, parallel to the core 11, and extend solely in the swollen portion of the brush. The facets 76 may cause the cross-section of the swollen portion to become somewhat triangular in shape, as can be seen in FIG. 23. Alternately, the facets could be configured differently.

Figure 23A:
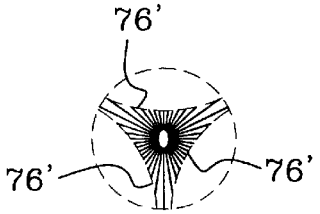
FIG. 23A is a view of a cross-section of a blank from which another exemplary embodiment of an applicator could be made.

In a variant shown in FIG. 23A, notches 76' could be made on the blank instead of facets 76. The notches 76' may be outwardly concave in cross-section.

Figure 24:
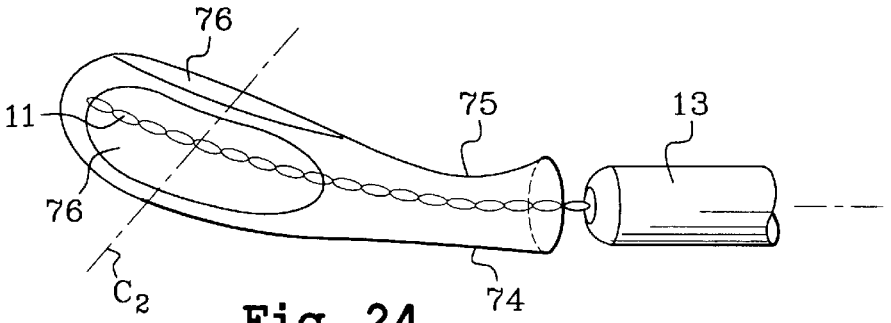
FIG. 24 is a schematic view of the blank of FIG. 22 with the core curved about a first axis.

Referring to FIGS. 22 and 24, the blank may be curved about a first axis C1 so as to deform its proximal portion and optionally to straighten out the bottom edge while imparting additional curvature to its top edge. The blank may also be curved about the axis C2, which may have the effect of making one of the facets 76 concave or convex. The axis C2 may lie in a plane perpendicular to the core 11 and may be parallel to the plane of a facet 76.

Figure 25:
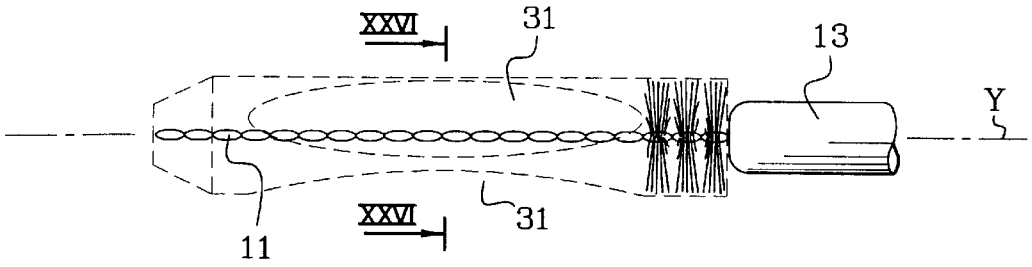
FIG. 25 is a schematic view of a blank similar to that of FIG. 6 with a plurality of notches.
Figure 26:
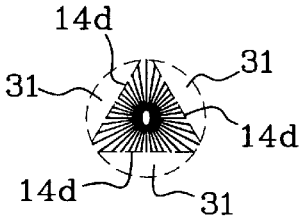
FIG. 26 is a view of a cross-section of the blank of FIG. 25 taken along plane XXVI—XXVI.
Figure 26A:
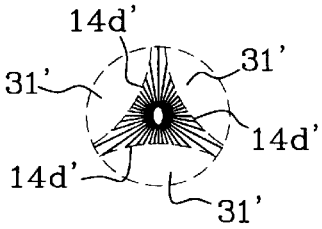
FIG. 26A is a view of a cross-section of a blank from which another exemplary embodiment of an applicator could be made.

FIGS. 25 and 26 show a blank that differs from the blank of FIG. 6 by the fact that it has three notches 31 instead of only one notch, thus giving the brush a shape that is generally triangular when observed in cross-section, as shown in FIG. 26. The notches 31 may have bottom walls 14*d* whose cross-section is flat. In a variant, the notches 31 could be replaced by notches 31' whose bottom walls 14*d'* may be outwardly concave, as shown in FIG. 26A. The notches 31' (FIG. 26A) may appear concave in profile when observed in a direction substantially perpendicular to the core 11, while the notches 76' (FIG. 23A) may appear rectilinear in profile when observed in a direction substantially perpendicular to the core 11.

Figure 27:
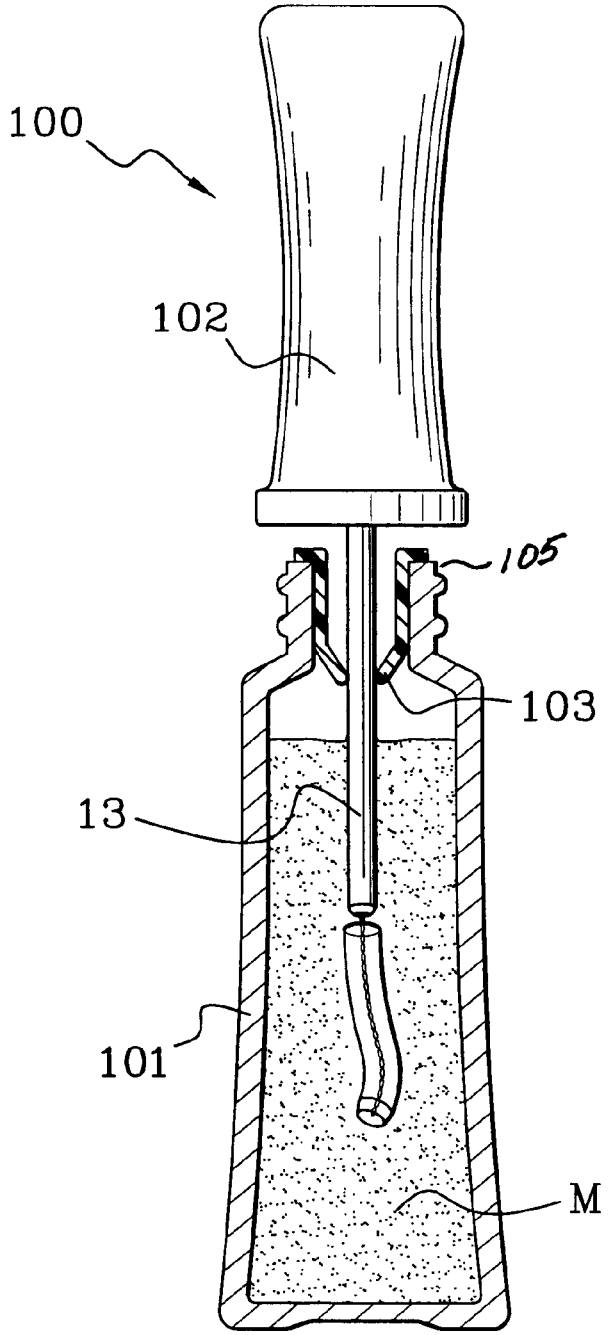
FIG. 27 is a view of an exemplary embodiment of a system for applying a product to keratinous fibers.

FIG. 27 is a view of a system 100 that includes an applicator in accordance with the invention and a receptacle 101. The applicator may comprise a stem 13 fixed to a cap 102. The cap 102 may optionally serve both as a handle and as a closure for closing (e.g., in a sealed manner) the receptacle 102 containing a product M for application to the eyelashes (e.g., a hair product such as a liquid mascara).

The receptacle 101 may have an outwardly threaded neck 105 with a wiper 103 optionally fixed on an inside of the receptacle 101. The wiper 103 may be of any conventional type. In an embodiment, the wiper 103 may be adapted to wipe the stem 13 while it is being extracted from the receptacle. The wiper may thus have an orifice whose diameter substantially matches that of the stem 13.

Because of the curvature of the core, when the applicator is observed in a direction substantially perpendicular to the axis Y of the stem 13, the applicator may have a profile that varies such that the applicator has regions suitable for performing different actions on the eyelashes.

When the applicator is rotated about the axis Y of the stem 13, the application members may perform an oscillating motion laterally, which can improve penetration of the application members between the eyelashes and can enable the application members to hold the eyelashes better.

The bristles can be given a particular orientation by appropriately selecting the curvature for the core.

For some applications, it may be useful to start with a left-hand pitch applicator, as explained below with reference to FIGS. 28 and 29.

Figure 28:
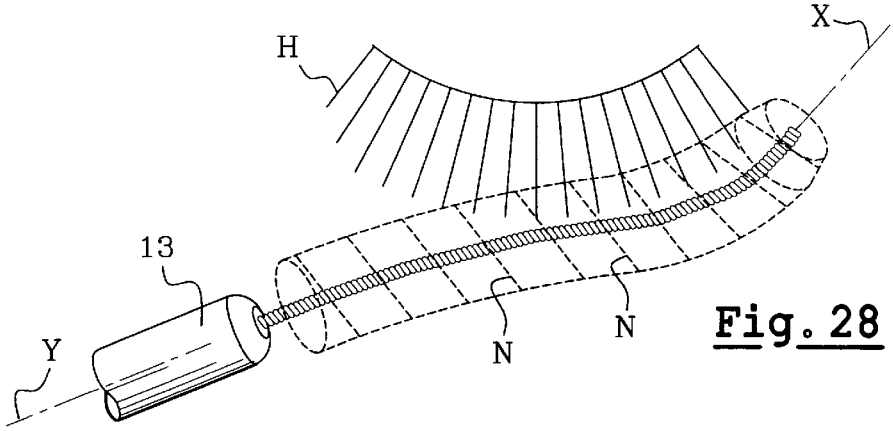
FIG. 28 is a schematic view showing the applicator of FIG. 3 with a left-hand pitch being used to apply a product to eyelashes.
Figure 29:
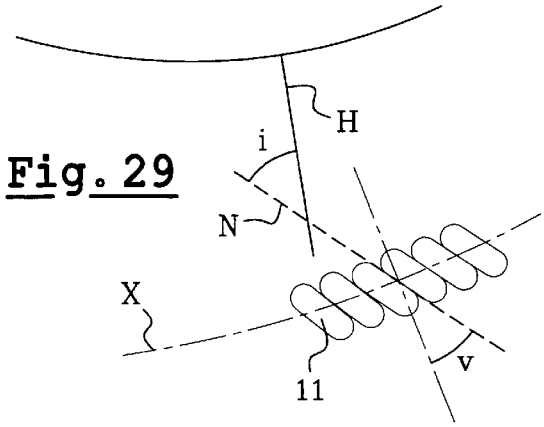
FIG. 29 is a schematic view of an exemplary embodiment of a left-hand pitch applicator showing various angles between a helical sheet defined by application members, an eyelash, and an axis of the core.

FIG. 28 shows the applicator of FIG. 3 with a core that is twisted using a left-hand pitch. The paths followed by the sheets N defined by ends of the application members (e.g., bristles) are represented by dashed lines. The sheets N are shown at an angle v (FIG. 29) relative to a plane perpendicular to the core. The angle between the sheets N and the axis Y of the stem decreases as the distance between the sheets N and the stem 13 increases. This feature may make it possible to create a relatively large angle (FIG. 29) between the eyelashes H at the end of the eyelid and the sheets N, thus making it possible to separate the eyelashes well.

Figure 30:
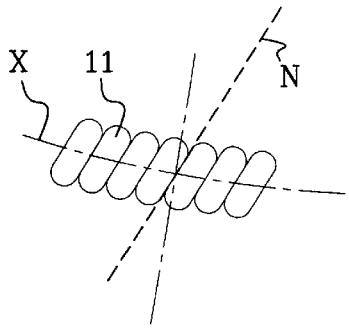
FIG. 30 is a view similar to FIG. 29 for an exemplary embodiment of a right-hand pitch applicator.

When the core has a right-hand twist, as shown in FIG. 30, it also may be possible to act on the curvature given to the core in order to orient the sheets in the chosen direction.

Figure 31:
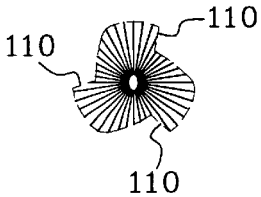
FIG. 31 is a view of a cross-section of an exemplary embodiment of an applicator having steps.

In an embodiment shown in FIG. 31, the applicator may have steps. The applicator of FIG. 31 has been machined in such a manner as to form setbacks 110 in its surface. The setbacks 110 may occupy at least a portion of the length of the applicator and may have flanks that are substantially radial.

Figure 32:
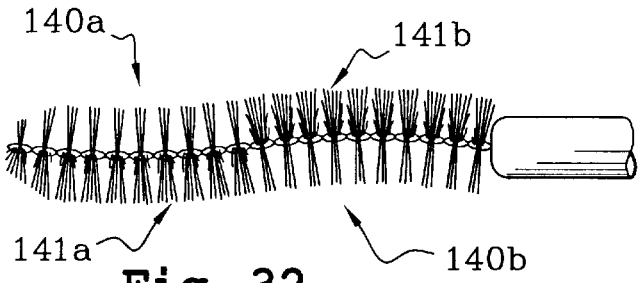
FIG. 32 is a partial side view of an exemplary embodiment of an applicator having a twisted core that does not lie in a plane and that has a cross-section generally triangular in shape.
Figure 33:
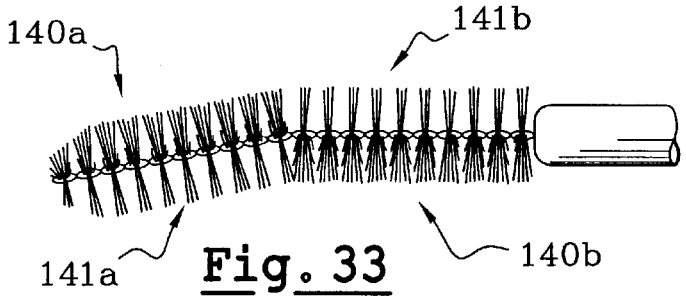
FIG. 33 is a view of the applicator of FIG. 32 after the applicator has been turned through about one-fourth of a turn about the axis of the stem.

FIGS. 32 and 33 show an embodiment of an applicator in which the twisted core has been curved about at least two non-parallel axes. As shown in FIG. 32, when seen from the side as though it were transparent, the applicator may include regions 140*a* and 140*b* with large gaps between tufts of bristles, and regions 141*a* and 141*b* with smaller gaps. The regions 140*a* and 141*a* may be diametrically opposite and extend substantially over the first half of the length of the applicator from its free end.

When the applicator is turned through about one-fourth of a turn, as shown in FIG. 33, it can be seen that the first top half 140*a* now has practically no gaps, while the first bottom half 141*a* has gaps that are considerably larger. The second top half 141*b* has larger gaps than in FIG. 32, while the second bottom half 140*b* has smaller gaps. This represents the various orientations of the application members along the applicator and shows one example of how it might be possible, via visual inspection, to identify certain exemplary applicators made in accordance with the invention.

Figure 34:
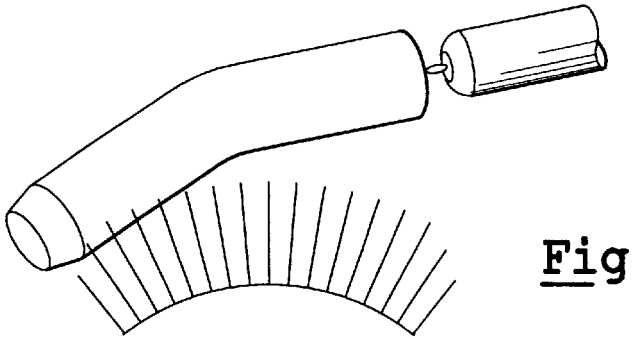
FIGS. 34 and 35 show different ways in which an applicator according to the invention may be used.
Figure 35:
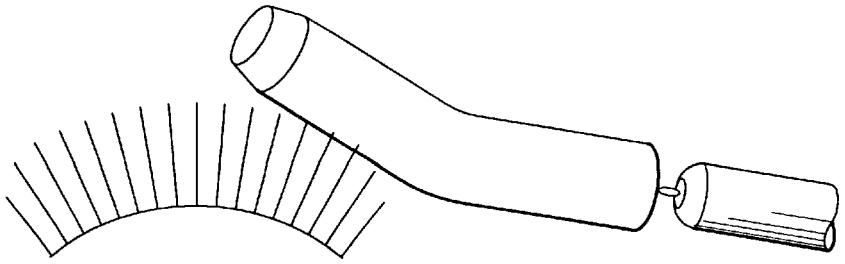

FIGS. 34 and 35 show various ways in which an applicator in accordance with the invention can be used. In FIG. 34, it can be seen that to make up the eyelashes at one end of the eyelid, it is possible to use an applicator in a first orientation. To make up the eyelashes at the other end of the eyelid, the applicator can be used in a second orientation, different from the first, and as shown in FIG. 35.

Figure 36:
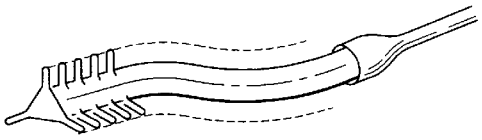
FIG. 36 is a partial schematic view of an applicator that is integrally molded.

Many of the exemplary embodiments described above relate to applicators having twisted cores. However, it would not go beyond the ambit of the present invention for the applicator to be made by injection molding an applicator, for example, injection molding an applicator with a thermoplastic material. FIG. 36 shows an exemplary embodiment of an injection molded application without a twisted core. Such an applicator can be made with an axis that is rectilinear and that is then deformed while hot, or in a variant the brush can be made in an already-curved state by giving the mold an appropriate shape. Applicators according to the invention may be made by other suitable manufacturing techniques as well.

Figure 39:
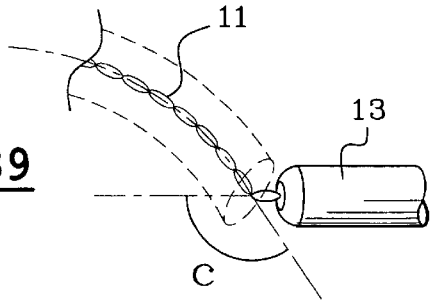
FIG. 39 is a partial schematic view of a portion of a core that is bent at an angle at an end adjacent to the stem.

Referring to FIG. 39, when the applicator has a twisted core, the core may be bent in the vicinity of its end fixed in the stem so as to form an angle c between the axis of the stem and the axis of the core close to the end of the applicator adjacent to the stem.

Figure 40:
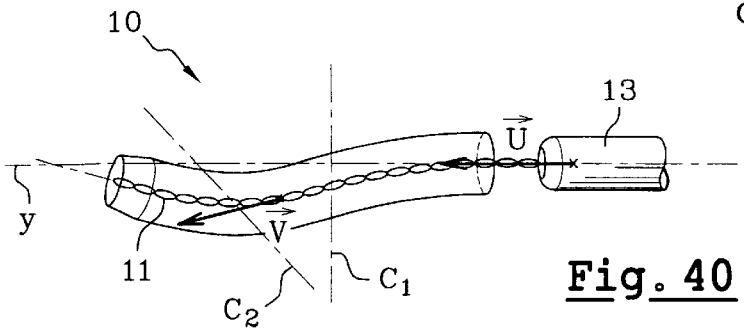
FIG. 40 is schematic view of the applicator of FIG. 3 showing directive vectors of the stem and a point along the core.

FIG. 40 shows the applicator of FIG. 3 with a directive vector u of the stem directed from the end of the stem linked to a handle member to the end of the stem fixed to the core. A directive vector v of the direction of the core at a point along the core, directed from the end of the stem fixed to the stem to the free end of the core, is also shown. In an embodiment, the angle between u and v is always less than 90°, regardless of the position of the vector v along the core.

The invention is not limited to the embodiments described above. For example, the core can be curved about more than two axes. In an embodiment, the core may be curved in an S-shape about two parallel axes and then curved about a third axis that is not parallel to the other two.

The curvature given to the core has been exaggerated in the drawings for greater clarity. The curvature of the core may be more or less than shown in the drawings. The curvature could be different without going beyond the ambit of the present invention, and in particular it could match the curvature of an eyelid.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. An applicator for applying a product to keratinous fibers, the applicator comprising:

a stem;

a core curved about at least two axes, the core having one end attached to the stem and a free end remote from the stem, the at least two axes being not parallel to one another; and a plurality of application members extending from the core, the plurality of application members being configured to apply the product to keratinous fibers.

2. The applicator of claim 1, wherein the at least two axes extend in directions perpendicular to one another.

3. The applicator of claim 1, wherein the applicator is made by curving the core of a blank, the blank having an envelope surface substantially circularly symmetrical about an axis of the core over at least a portion of a length of the blank.

4. The applicator of claim 1, wherein the applicator is made from a blank comprising at least one of a notch and a facet.

5. The applicator of claim 4, wherein the blank comprises at least one facet, the at least one facet being substantially planar.

6. The applicator of claim 4, wherein the blank comprises at least one notch, the at least one notch having a cross-section that is convex in shape.

7. The applicator of claim 4, wherein the blank comprises an odd number of at least one of facets and notches.

8. The applicator of claim 7, wherein the blank comprises at least one of three facets and three notches, the blank being substantially prismatic-shaped over at least a portion of a length of the blank.

9. The applicator of claim 8, wherein the blank has a cross-section substantially triangular over at least a portion of a length of the blank.

10. The applicator of claim 1, wherein the applicator is made from a blank having a cross-section that varies over at least a portion of a length of the blank.

11. The applicator of claim 10, wherein the variance of the cross-section of the blank is not geometrically similar.

12. The applicator of claim 1, wherein the applicator is made by curving the core of a blank about first and second axes, and wherein, after the core of the blank is curved about the first axis, a cross-section of the blank is non-symmetrical about a plane perpendicular to the plane of curvature of the core at the point of cross-section.

13. The applicator of claim 1, wherein the applicator comprises a portion including one of a notch and a facet, and wherein, when the core is straightened to be substantially rectilinear, a width of the one of the notch and the facet passes through a maximum between ends of the one of the notch and the facet.

14. The applicator of claim 1, wherein the applicator is made from a blank having a substantially peanut-shaped envelope surface.

15. The applicator of claim 1, wherein the applicator is made from a blank having a substantially bullet-shaped envelope surface.

16. The applicator of claim 1, wherein the applicator is made from a blank having a substantially buoy-shaped envelope surface.

17. The applicator of claim 1, wherein the applicator is made from a blank having a substantially fish-shaped envelope surface.

18. The applicator of claim 1, wherein the applicator is made from a blank having a substantially hourglass-shaped envelope surface.

19. The applicator of claim 1, wherein the applicator is made from a blank having a substantially football-shaped envelope surface.

20. The applicator of claim 1, wherein the applicator is made from a blank having a cross-section that passes through at least one extreme value between axial ends of the applicator.

21. The applicator of claim 1, wherein the core is located off-center with respect to a cross-section of the applicator over at least a portion of a length of the core.

22. The applicator of claim 1, wherein the core is twisted.

23. The applicator of claim 22, wherein the core comprises at least one twisted wire.

24. The applicator of claim 23, wherein the applicator further comprises a stem having an axis, the core being at an end of the stem.

25. The applicator of claim 24, wherein the core has a left-hand pitch.

26. The applicator of claim 25, wherein the plurality of application members comprises bristles.

27. The applicator of claim 26, wherein ends of the bristles define helical sheets, and wherein the core is curved so as to reduce an angle of inclination of the helical sheets relative to the axis of the stem as the distance from the helical sheets to stem increases.

28. The applicator of claim 1, wherein the plurality of application members comprises bristles of different lengths.

29. The applicator of claim 28, wherein the bristles of different lengths comprise shorter bristles and longer bristles, the shorter bristles being contained within a volume defined by an envelope surface defined by the longer bristles.

30. The applicator of claim 1, wherein the plurality of application members comprises bristles.

31. The applicator of claim 1, wherein the application members are configured to apply mascara to eyelashes.

32. The applicator of claim 1, further comprising a stem, the core being at an end of the stem.

33. The applicator of claim 32, wherein the core is curved such that an axis of the stem and any line tangent to an axis of the core do not extend in directions substantially perpendicular to one another.

34. The applicator of claim 32, further comprising a handle, the handle being at the end of the stem opposite from the core.

35. A system for applying a product to keratinous fibers, the system comprising:

the applicator of claim 1; and a receptacle for containing the product.

36. The system of claim 35, further comprising the product in the receptacle.

37. The system of claim 36, wherein the product is a hair product.

38. The system of claim 37, wherein the product is mascara.

39. A method of applying a product to eyelashes, the method comprising:

providing the system of claim 36;

loading the applicator with a supply of product from the receptacle; and applying the product to eyelashes with the applicator.

40. The method of claim 39, wherein the loading of the applicator comprises loading the applicator with a supply of hair product.

41. The method of claim 40, wherein the loading of the applicator comprises loading the applicator with a supply of mascara.

42. The method of claim 39, wherein the system comprises a wiper, and wherein the method further comprises wiping excess product from the applicator with the wiper.

43. The method of claim 39, wherein the loading of the product comprises inserting at least a part of the applicator into the receptacle.

44. The method of claim 43, wherein the system comprises a wiper on the receptacle, and wherein the method further comprises wiping the applicator with the wiper when the applicator is withdrawn from the receptacle.

45. The system of claim 35, further comprising a wiper for wiping product from the applicator.

46. The system of claim 45, wherein the wiper is on the receptacle.

47. The system of claim 35, where the applicator comprises a handle, the core being coupled to an end of the handle.

48. The system of claim 47, wherein the applicator comprises a stem, the core being at a first end of the stem and the handle being at a second end of the stem.

49. The system of claim 48, wherein the handle is configured to be a cap for the receptacle.

50. The system of claim 35, further comprising a cap for the receptacle.

51. The system of claim 35, wherein the system is configured such that at least a portion of the applicator is capable of being stored in the receptacle.

52. A method of manufacturing an applicator for applying a product to keratinous fibers, the method comprising:

providing a blank for an applicator, the blank having a core and a plurality of application members extending from the core, the plurality of application members being configured to apply a product to keratinous fibers;

curving the core about a first axis; and curving the core about a second axis, the second axis being not parallel to the first axis, wherein the core does not have a helical configuration after being curved about the first and second axes.

53. The method of claim 52, wherein the blank has at least one substantially planar side face, and wherein the curving of the core about one of the first and second axes causes the substantially planar side face to become one of substantially concave and substantially convex.

54. The method of claim 53, wherein the curving of the core about one of the first and second axes comprises curving the core in a plane of curvature constituting a midplane of symmetry for the side face.

55. The method of claim 52, wherein the blank has at least one substantially concave side face, and wherein the curving of the core about at least one of the first and second axes causes the substantially concave side face to become substantially planar.

56. The method of claim 37, wherein the curving of the core about one of the first and second axes comprises curving the core in a plane of curvature constituting a midplane of symmetry for the side face.

57. The method of claim 52, wherein the blank has at least one substantially convex side face, and wherein the curving of the core about at least one of the first and second axes causes the substantially convex side face to become substantially planar.

58. The method of claim 57, wherein the curving of the core about one of the first and second axes comprises curving the core in a plane of curvature constituting a midplane of symmetry for the side face.

59. The method of claim 52, wherein the blank has a substantially rectilinear edge, and wherein the curving of the core about at least one of the first and second axes causes the substantially rectilinear edge to become curved.

60. The method of claim 59, wherein the curving of the core about one of the first and second axes comprises curving the core in a plane of curvature containing the edge.

61. The method of claim 52, wherein the blank has a curved edge, and wherein the curving of the core about at least one of the first and second axes causes the curved edge to become substantially rectilinear.

62. The method of claim 61, wherein the curving of the core about one of the first and second axes comprises curving the core in a plane of curvature containing the edge.

63. The method of claim 52, wherein the blank used for making the applicator has an envelope surface in the shape of one of a cylinder, a peanut, a buoy, a fish, an hourglass, and a football.

64. The method of claim 52, wherein the blank comprises at least one of at least one facet and at least one notch.

65. The method of claim 52, wherein the blank has a non-rectilinear edge and is asymmetrical about a midplane of the blank, and wherein the curving of the core about one of the first and second axes substantially straightens out at least a part of the non-rectilinear edge.

66. The method of claim 65, wherein the curving of the core about one of the first and second axes causes the non-rectilinear edge to become substantially rectilinear.

67. The method of claim 52, further comprising making the blank for the applicator.

68. The method of claim 52, wherein the providing comprises providing a blank having a rectilinear core.

69. An applicator manufactured according to the method of claim 52.

70. An applicator for applying a product to keratinous fibers, the applicator comprising:

a stem;

a core forced into a distal end of the stem; and a plurality of application members extending from the core, the plurality of application members being configured to apply the product to keratinous fibers, wherein the core is curved such that an axis of the core does not lie entirely in any single plane.

71. The applicator of claim 70, wherein the plurality of application members define an envelope surface, the envelope surface having at least one of a notch and a facet.

72. The applicator of claim 70, further comprising a stem having an axis, the core being at an end of the stem.

73. The applicator of claim 72, wherein the core is curved such that an axis of the stem and any line tangent to an axis of the core do not extend in directions perpendicular to one another.

74. The applicator of claim 70, wherein the core is formed of at least one twisted wire, and wherein the plurality of application members comprises bristles.

75. A system for applying a product to keratinous fibers, the system comprising:

the applicator of claim 70; and a receptacle containing a product.

76. The system of claim 75, further comprising a wiper for wiping excess product from the applicator.

77. The system of claim 76, wherein the wiper is on the receptacle.

78. A method of applying a product to eyelashes, the method comprising:

providing the system of claim 76;

loading the applicator with a supply of product from the receptacle; and applying the product to eyelashes with the applicator.

79. The method of claim 78, wherein the loading of the applicator comprises loading the applicator with a supply of hair product.

80. The method of claim 79, wherein the loading of the applicator comprises loading the applicator with a supply of mascara.

81. The method of claim 78, wherein the system comprises a wiper, and wherein the method further comprises wiping excess product from the applicator with the wiper.

82. The method of claim 81, wherein the loading of the product comprises inserting at least a part of the applicator into the receptacle.

83. The method of claim 82, wherein the system comprises a wiper on the receptacle, and wherein the method further comprises wiping excess product from the applicator with the wiper.

84. The system of claim 75, wherein the applicator comprises a handle, the core being coupled to an end of the handle.

85. The system of claim 84, wherein the applicator comprises a stem, the core being at a first end of the stem and the handle being at a second end of the stem.

86. The system of claim 84, wherein the handle is configured to be a cap for the receptacle.

87. The system of claim 75, further comprising a cap for the receptacle.

88. The system of claim 75, wherein the system is configured so that at least a portion of the applicator is capable of being stored in the receptacle.

89. An applicator for applying a product to keratinous fibers, the applicator comprising:

a core curved about at least two axes, the at least two axes being not parallel to one another; and a plurality of application members extending from the core, the plurality of application members being configured to apply the product to keratinous fibers, wherein the core is curved such that the curved portion of the core defines at least two arcs each having ends and a center of curvature, and wherein each of the at least two arcs defines an angle having a vertex defined by the center of curvature and legs defined by lines connecting ends of the arc to the center of curvature, the angle being less than 90°.

90. The applicator of claim 89, wherein the plurality of application members define an envelope surface, the envelope surface having at least one of a notch and a facet.

91. The applicator of claim 89, further comprising a stem having an axis, the core being at an end of the stem.

92. The applicator of claim 89, wherein the core is formed of at least one twisted wire, and wherein the plurality of application members comprises bristles.

93. A system for applying a product to keratinous fibers, the system comprising:

the applicator of claim 89; and a receptacle containing a product.

94. The system of claim 93, further comprising a wiper for wiping excess product from the applicator.

95. The system of claim 94, wherein the wiper is on the receptacle.

96. The system of claim 93, wherein the applicator comprises a handle, the core being coupled to an end of the handle.

97. The system of claim 96, wherein the applicator comprises a stem, the core being at a first end of the stem and the handle being at a second end of the stem.

98. The system of claim 96, wherein the handle is configured to be a cap for the receptacle.

99. The system of claim 93, further comprising a cap for the receptacle.

100. The system of claim 93, wherein the system is configured so that at least a portion of the applicator is capable of being stored in the receptacle.

101. A method of applying a product to eyelashes, the method comprising:

providing the system of claim 93;

loading the applicator with a supply of product from the receptacle; and applying the product to eyelashes with the applicator.

102. The method of claim 101, wherein the loading of the applicator comprises loading the applicator with a supply of hair product.

103. The method of claim 102, wherein the loading of the applicator comprises loading the applicator with a supply of mascara.

104. The method of claim 101, wherein the system comprises a wiper, and wherein the method further comprises wiping excess product from the applicator with the wiper.

105. The method of claim 101, wherein the loading of the product comprises inserting at least a part of the applicator into the receptacle.

106. The method of claim 105, wherein the system comprises a wiper on the receptacle, and wherein the method further comprises wiping excess product from the applicator with the wiper.

107. An applicator for applying a product to keratinous fibers, the applicator comprising:

a core curved such that an axis of the core does not lie entirely in any single plane;

a stem associated with the core; and a plurality of application members extending from the core, the plurality of application members being configured to apply the product to keratinous fibers, wherein the core is curved such that an axis of the stem and any line tangent to the axis of the core do not extend in directions substantially perpendicular to one another.

108. An applicator for applying a product to keratinous fibers, the applicator comprising:

a core curved about at least two axes, the at least two axes being not parallel to one another; and a plurality of application members extending from the core, the plurality of application members being configured to apply the product to keratinous fibers, wherein the applicator is made from a blank having a cross-section that varies over at least a portion of a length of the blank.

109. An applicator for applying a product to keratinous fibers, the applicator comprising:

a core curved about at least two axes such that the core does not form a loop, the at least two axes being not parallel to one another; and a plurality of application members extending from the core, the plurality of application members being configured to apply the product to keratinous fibers.

110. An applicator for applying a product to keratinous fibers, the applicator comprising:

a core curved about at least two axes, the at least two axes being of a finite number and not parallel to one another; and a plurality of application members extending from the core, the plurality of application members being configured to apply the product to keratinous fibers.

111. An applicator for applying a product to keratinous fibers, the applicator comprising:

a core; and a plurality of application members extending from the core, the plurality of application members being configured to apply the product to keratinous fibers, wherein the core is curved such that an axis of the core does not lie entirely in any single plane, and does not have a helical configuration.

112. An applicator for applying a product to keratinous fibers, the applicator comprising:

a core curved about at least two axes and being self supporting, the at least two axes being not parallel to one another; and a plurality of application members extending from the core, the plurality of application members being configured to apply the product to keratinous fibers.

113. An applicator for applying a product to keratinous fibers, the applicator comprising:

a core; and a plurality of application members extending from the core, the plurality of application members being configured to apply the product to keratinous fibers, wherein the core is self supporting and curved such that an axis of the core does not lie entirely in any single plane.

* * * * *

UNITED STATES PATENT AND TRADEMARK OFFICE

CERTIFICATE OF CORRECTION

PATENT NO. : 6,662,810 B2
DATED : December 16, 2003
INVENTOR(S) : Jean-Louis H. Gueret It is certified that error appears in the above-identified patent and that said Letters Patent is hereby corrected as shown below:

Column 5,
Line 63, “may causes” should read -- may cause --.

Column 6,
Line 52, “having a an envelope” should read -- having an envelope --.
Line 67, “plane” should read -- planar --.

Column 8,
Line 49, “is schematic” should read -- is a schematic --.

Column 17,
Line 17, “claim 37,” should read -- claim 55, --.

Signed and Sealed this

Ninth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,662,810 B2
DATED : December 16, 2003
INVENTOR(S) : Gueret

It is certified that error appears in the above-identified patent and that said Letters Patent is hereby corrected as shown below:

Column 14,
Line 55, “convex” should read -- outwardly concave --.

Signed and Sealed this

Twenty-first Day of September, 2004

JON W. DUDAS
*Director of the United States Patent and Trademark Office*